United States Patent [19]

Herdin et al.

[11] Patent Number: 4,570,588

[45] Date of Patent: Feb. 18, 1986

[54] APPARATUS FOR AUTOMATICALLY CONTROLLING THE INJECTION OF FUEL IN DIESEL ENGINES

[75] Inventors: Günther H. Herdin, Steyr; Walter Hack, Ternberg, both of Austria

[73] Assignee: Steyr-Daimler-Puch Aktiengesellschaft, Vienna, Austria

[21] Appl. No.: 609,192

[22] Filed: May 11, 1984

[30] Foreign Application Priority Data

May 20, 1983 [AT] Austria ..... 1852/83

[51] Int. Cl.[4] ..... F02B 77/08; G05G 11/00

[52] U.S. Cl. ..... 123/198 DB; 123/365

[58] Field of Search ..... 123/198 D, 198 DB, 385, 123/386, 387, 372, 373, 365, 374, 364

[56] References Cited

U.S. PATENT DOCUMENTS

| | | | |
|---|---|---|---|
| 2,854,964 | 10/1958 | Wagner | 123/198 DB |
| 3,572,303 | 3/1971 | Becker | 123/365 |
| 3,910,134 | 10/1975 | Akagi | 123/198 D |
| 3,918,318 | 11/1975 | Phillips | 123/198 DB |
| 4,023,550 | 5/1977 | Houston | 123/198 D |
| 4,108,129 | 8/1978 | Rognon | 123/198 DB |
| 4,138,601 | 2/1979 | Nakamura | 123/198 DB |
| 4,331,114 | 5/1982 | Karraker | 123/198 D |
| 4,351,293 | 9/1982 | Hewitt | 123/198 D |
| 4,387,679 | 6/1983 | Folger | 123/198 DB |

FOREIGN PATENT DOCUMENTS

| | | | |
|---|---|---|---|
| 0069111 | 6/1982 | European Pat. Off. | 123/372 |
| 2311692 | 3/1973 | Fed. Rep. of Germany | 123/372 |
| WO82/01037 | 4/1982 | PCT Int'l Appl. | 123/365 |

*Primary Examiner*—Carl Stuart Miller

*Attorney, Agent, or Firm*—Karl F. Ross; Herbert Dubno

[57] ABSTRACT

Apparatus for controlling the quantity of fuel injected per shot or the beginning of fuel injection in a diesel engine comprises a control rod, which is adjustable by a stepping motor through the intermediary of a resiliently yieldable coupling. The control rod acts to control the injection pump or pumps. In order to provide a structurally simple apparatus which comprises a low-power stepping motor and to eliminate backlash between the cooperating elements of the apparatus, the shaft of the stepping motor carries a camwheel, which is indirectly engaged by the control rod, which is biased by a spring. The resiliently yieldable coupling can be coaxial with the camwheel and adapted to rotate as far as to stop only in one sense of rotation whereas the coupling is rigidly connected to the camwheel for a movement in the other sense of rotation. Alternatively, the coupling can consist of two coupling levers, which are adapted to be pivotally moved apart about a common axis from a position of rest, which is defined by a stop. One of said two coupling levers engages the cam of the camwheel, which is nonrotatably connected to the shaft of the stepping motor. The other of said coupling levers engages an abutment carried by the control rod.

16 Claims, 4 Drawing Figures

APPARATUS FOR AUTOMATICALLY CONTROLLING THE INJECTION OF FUEL IN DIESEL ENGINES

FIELD OF THE INVENTION

This invention relates to apparatus for automatically controlling the quantity of fuel injected per shot or the beginning of fuel injection in diesel engines, which apparatus comprises a control rod, which controls one or more fuel injection pumps and is adjustable by a stepping motor through the intermediary of a resiliently yielding coupling.

BACKGROUND OF THE INVENTION

In a known apparatus of this kind, the stepping motor is operatively connected to the axially displaceable control rod by a rack and pinion drive so that the backlash between the stepping motor and the control rod adversely affects the control particularly during operation under no load. Another important disadvantage which often arises is that the means for transmitting force from the stepping motor to the control rod do not include a resilient member so that the stepping motor must be very powerful and large because very high frictional forces must be overcome during the injection of fuel. If a stepping motor is used which is less powerful and cannot adjust the control rod during the injection of fuel, additional signalling means are required to indicate that no adjustment has been effected.

In another apparatus, which is known from European Patent Publication No. 0 069 111, a mechanical energy storage device is connected between the control rod, the associated actuating motor consisting, e.g., of a stepping motor and that energy storage device comprises two spring discs, which are movable relative to each other, and a prestressed compression spring disposed between said spring discs, the maximum separation of which is defined by stops in a housing which embraces the two spring discs. In that case too, a rack-and-pinion drive, which involves a backlash, is connected between the actuating motor, e.g., the stepping motor, and the linkage which includes the energy storage device, and a backlash is likely to occur also in the linkage.

OBJECT OF THE INVENTION

It is an object of the invention to eliminate these disadvantages and to provide an apparatus which is of the kind described first hereinbefore and is free of backlash, is relatively simple in structure, comprises a low-power stepping motor and does not require a feedback signalling device.

SUMMARY OF THE INVENTION

This object is accomplished in accordance with the invention in that a camwheel is rotatable about the axis of the shaft of the stepping motor, the control rod is held by a spring in indirect engagement with the cam of the camwheel, and the resiliently yieldable coupling is either coaxial with the camwheel and is angularly yieldable only in one sense of rotation as far as to a stop and in the other sense of rotation is rigidly connected to the camwheel wheel, or the resiliently yieldable coupling consists of two coupling levers, which are pivotally movable apart from each other about a common axis against spring force from a position of rest defined by a stop. One of these coupling levers engages the cam of the camwheel, which is nonrotatably connected to the shaft of the stepping motor, whereas the other coupling lever engages an abutment carried by the control rod.

Because the control rod is urged by the force of a spring against the cam of the camwheel, there will be no backlash between the cam and the control rod although the latter is not directly supported. The resiliently yieldable coupling constitutes an energy storage device, which will be stressed when the relatively weak stepping motor has not been able to effect the adjusting movement during the injection of fuel and will thereafter adjust the control rod as soon as the injection of fuel has been terminated. In both embodiments of the invention the apparatus is relatively simple in structure and reliable in operation.

The coupling member which is coaxial with the camwheel consists, in accordance with the invention, of a plate, which is nonrotatably connected to the shaft of the stepping motor and comprises a coupling pin parallel to the axis of the coupling disc, and a bore angularly spaced from the coupling pin, whereas the camwheel is formed with a coupling pin and a bore which cooperate with the bore and the coupling pin of the coupling plate. Each coupling pin carried by one part enters the bore of the other part and is much smaller in diameter than said bore. The two coupling pins are interconnected by a spring. Because the bores are much larger in diameter than the coupling pins, the coupling plate and camwheel are capable of performing the required angular movement relative to each other. The spring connecting the two coupling pins constitutes an energy storage device, and the walls of the bores constitute the stops which are engageable by the coupling pins.

If the resiliently yieldable coupling consists of two coupling levers pivoted on the same axis, a particularly simple and functionally reliable structure will be obtained if one of the two coupling levers carries a stop engageable by the other lever, and a spring is provided, which acts on said one coupling lever and pulls the other coupling lever against the stop.

In order to prevent damage to the entire fuel injection system or an intake of air in case of an interruption of the supply of fuel, a further feature of the invention resides in the provision of a shutdown piston biased by a shutdown spring and to which fluid pressure opposing the force of said shutdown spring is applied from the fuel line, and that shutdown piston is connected to the control rod by a shutdown lever, which may constitute one coupling lever of the resiliently yieldable coupling. In such an arrangement the control rod will be moved to a position of rest in response to a drop of the fuel pressure. This shutdown mechanism affords perfect safety even in case of a failure of the electronic control.

BRIEF DESCRIPTION OF THE DRAWING

Two illustrative embodiments of the invention are shown on the drawing, in which.

SPECIFIC DESCRIPTION

Figure 1:
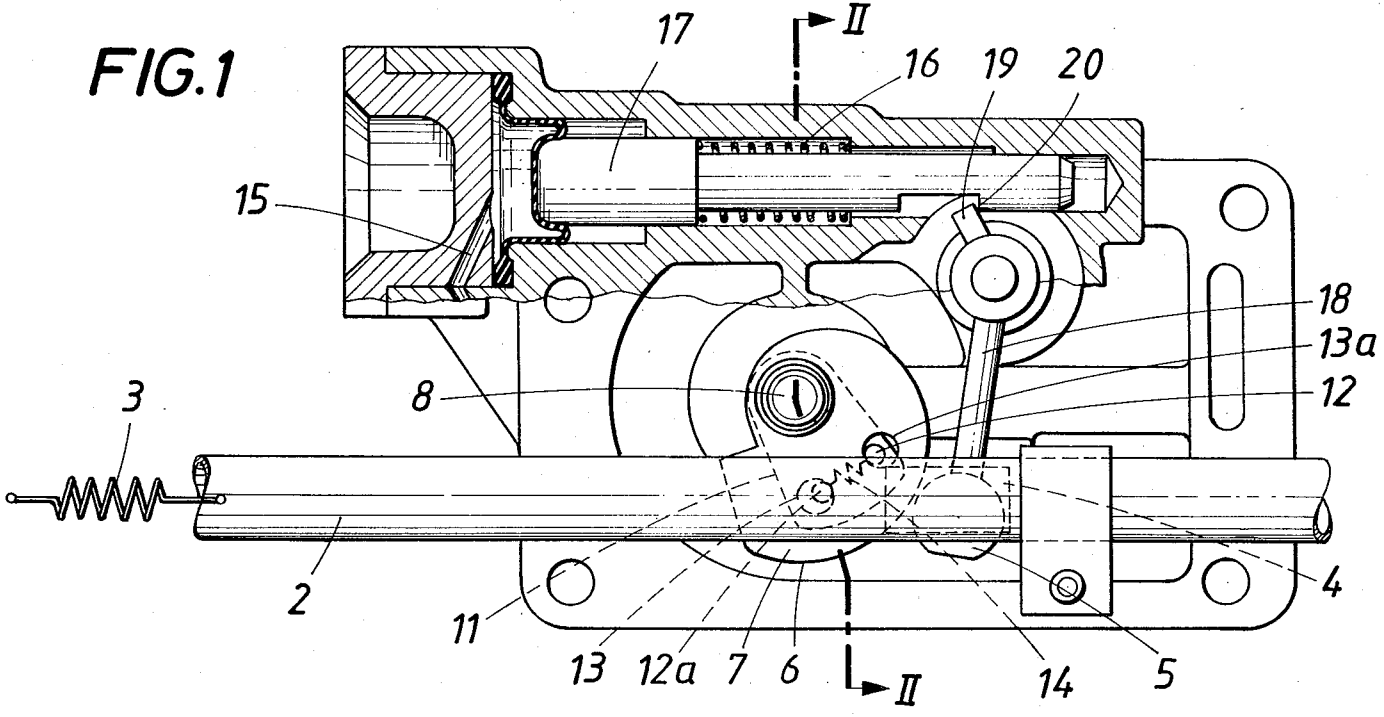
FIG. 1 is a partly sectional view showing apparatus for an automatic control of the quantity of fuel injected per shot.
Figure 2:
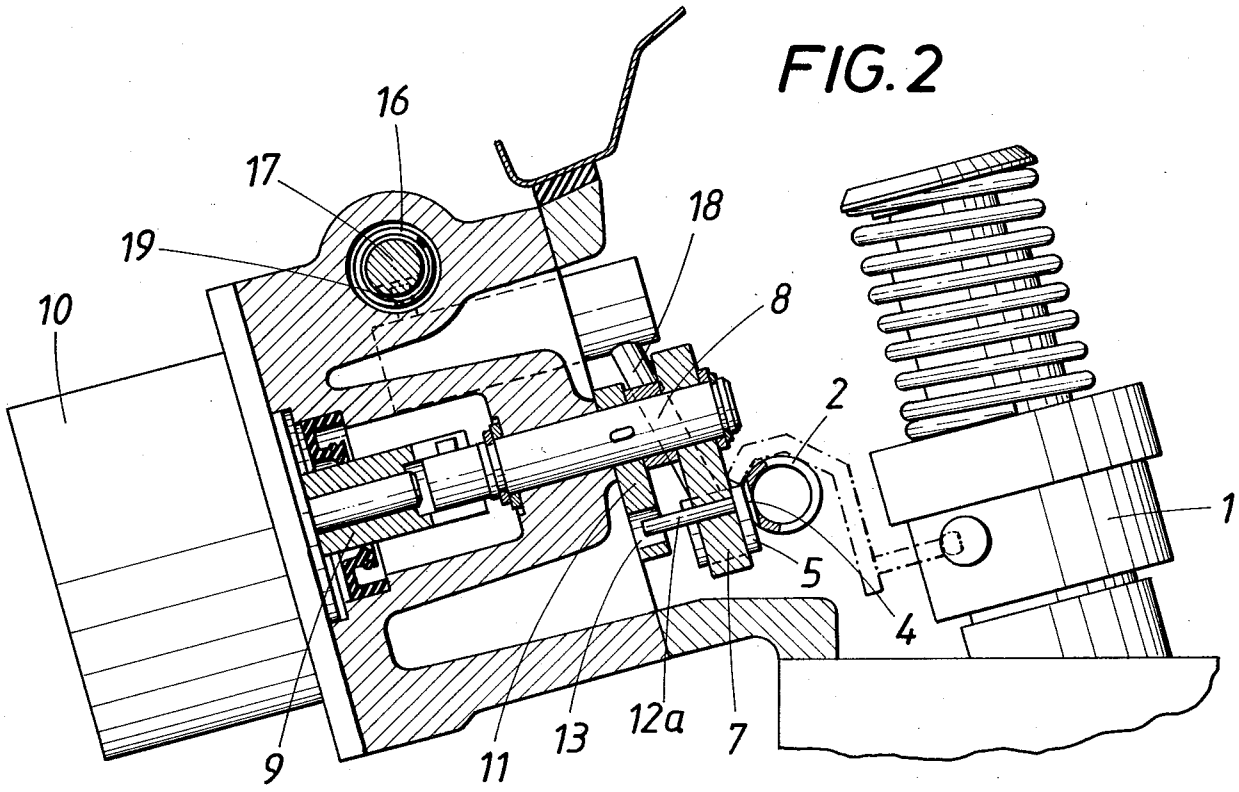
FIG. 2 is a transverse sectional view taken along line II—II in FIG. 1.

In accordance with FIGS. 1 and 2 the means for controlling each of the fuel injection pumps of a diesel engine are actuated by an adjustable control rod 2 urged by a spring 3 toward its full-load position and bearing on a cam 6 of a camwheel 7 through the intermediary of an abutment surface 4 and an interposed member 5.

The camwheel 7 is freely rotatably mounted on a shaft 8 coupled to the shaft 9 of a stepping motor 10. A sector-shaped coupling plate 11 is non-rotatably connected to the shaft 8 and carries a coupling pin 12, parallel to the axis of the shaft 8 and is provided with a bore 13 angularly spaced from the coupling pin 12.

The camwheel 7 is provided with a pin 12*a* and a bore 13*a*, which cooperate with the bore 13 and the pin 12, respectively. The two coupling pins 12, 12*a* are interconnected by a tension spring 14. The bores 13, 13*a* are much larger in diameter than the coupling pins 12, 12*a*. If the control rod 2 is blocked for a short time during a rotation of the stepping motor 10, the coupling plate 8 will perform an angular movement which is permitted by the backlash between the coupling pins 12, 12*a* and the bores 13, 13*a*. As a result, the coupling plate 11 and the stepping motor 10 can perform an initial angular movement, which is not transmitted to the camwheel 7, and the spring 14 will be stressed accordingly. As soon as the control rod 2 is free to move, the spring 14 contracts so that the camwheel 7 is rotated to the position that has been predetermined by the stepping motor and the required adjustment is imparted to the control rod 2.

A shutdown piston 17 is provided, which is biased by a shutdown spring 16 and to which fluid pressure opposing the force of the spring 16 is applied from the fuel line 15. The force of the spring 16 exceeds the force of the backing spring 3 urging the control rod 2 toward its full-load position. The interposed member 5 is carried by one arm 18 of a lever whose shorter second arm 19, cooperates with an edge 20 of the shutdown piston 17. In response to a drop of the fuel pressure, the spring 16 displaces the shutdown piston 17 to the left in FIG. 1 so that the lever 18, 19 is rotated in the counterclockwise sense, the interposed element 5 is disengaged from the cam 6 of the camwheel 7, and the control rod 2 is displaced to its zero position against the force of the spring 3.

Figure 3:
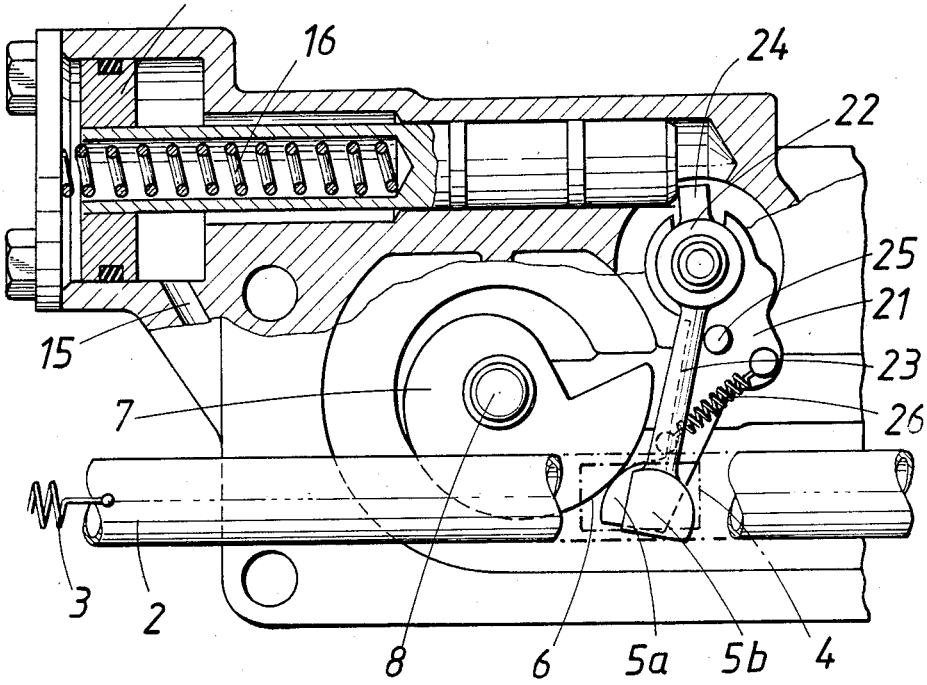
FIG. 3 is a view similar to FIG. 1 and illustrating a modification.
Figure 4:
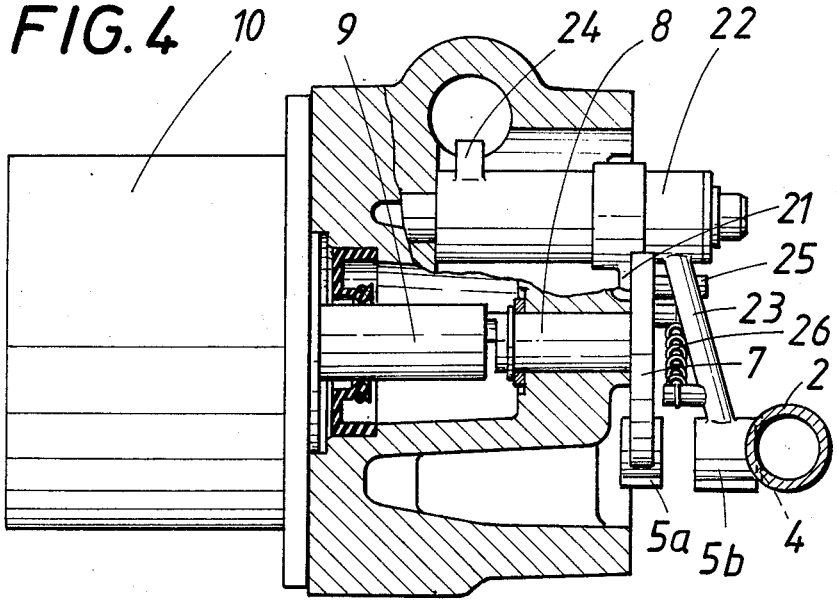
FIG. 4 is a transverse sectional view showing the arrangement of FIG. 3.

In the embodiment shown in FIGS. 3 and 4, those components which are used also in the embodiment shown in FIGS. 1 and 2 are designated with the same reference characters. By contrast with the embodiment shown in FIGS. 1 and 2, the spring 3 urges the control rod 2 toward its zero position and the camwheel 7 is nonrotatably connected to the shaft 8, which is coupled to the shaft 9 of the stepping motor 10. A lever 21 is freely rotatably mounted on the hub 22 of a two-armed lever 23, 24 and has a free end portion 5*a*, which corresponds to the interposed element 5 and engages the cam 6 of the camwheel 7. The free end of the lever arm 23 carries an interposed element 5*b*, which cooperates with the abutment surface 4 of the control rod 2. The lever 21 is provided with a stop pin 25, which is engaged by the lever arm 23 of the lever 23, 24 under the action of a spring 26, which is connected at one end to the lever 21 and at the other end on the lever arm 23.

If the control rod 2 is blocked for a short time during a rotation of the stepping motor 10, the lever 21 is initially moved alone so that the spring 26 is stressed and the rotation of the stepping motor 10 is not transmitted to the control rod 2. As soon as the latter is free to move, the spring 26 contracts to impart a corresponding adjustment to the control rod 2.

The lever arm 24 of the lever 23, 24 cooperates with the shutdown piston 17. In response to a drop of the fuel pressure, the spring 16 acts to push the shutdown piston 17 to the right in FIG. 3 so that the lever 23, 24 is pivotally moved in the clockwise sense to the zero position under the action of the two springs 3 and 16.

What is claimed is:

1. In an apparatus for controlling the injection of fuel from at least one fuel injection pump in a diesel engine, comprising a control rod which is axially adjustable and adapted to control said at least one fuel injection pump in dependence on an axial position of said control rod, a stepping motor having a rotary output shaft, and a mechanism comprising a resiliently yieldable coupling and connected to said shaft and to said control rod and adapted to impart an axial movement to said control rod in response to a rotary movement of said shaft, the improvement wherein said mechanism comprises a camwheel rotatable about the axis of said shaft and having a cam, an interposed element disposed between and engaging said control rod and said cam, a spring biasing said control rod in one axial direction to bear against said cam through the intermediary of said interposed movable element so that said control rod is arranged to move against the force of said spring in response to a rotation of said camwheel in one sense, a coupling member constituting part of said resiliently yieldable coupling and nonrotatably connected to said shaft, coupling means constituting part of said resiliently yieldable coupling and permitting a limited angular movement of said coupling member relative to said camwheel in one sense and arranged to rigidly couple said coupling member to said camwheel during an angular movement of said coupling member in the opposite sense, and spring means opposing an angular movement of said coupling member relative to said camwheel in said one sense, said coupling member comprising a coupling plate, which is nonrotatably connected to said shaft, said coupling means comprising a first bore formed in said coupling plate, a second bore formed in said camwheel, a first coupling pin carried by said camwheel and protruding into said first bore with an angular backlash about the axis of said shaft, and a second coupling pin carried by said coupling plate and protruding into said second bore with an angular backlash about the axis of said shaft, said first and second bores and said first and second coupling pins being parallel to the axis of said shaft, and said spring means comprising a tension spring interconnecting said first and second coupling pins.

2. The improvement set forth in claim 1 wherein said control rod is constructed and arranged to control the quantity of fuel injected by said at least one fuel injection pumps per shot.

3. The improvement set forth in claim 1 wherein said control rod is constructed and arranged to control the beginning of the injection of fuel from each of said at least one fuel injection pumps for each shot.

4. The improvement set forth in claim 1, wherein said coupling means comprise stop means limiting an angular movement of said coupling member relative to said camwheel in said one sense.

5. The improvement set forth in claim 1, wherein said first and second bores and said first and second coupling pins are circular in cross-section, said first bore is substantially larger in diameter than said first coupling pin and said second bore is substantially larger in diameter than said second coupling pin.

6. The improvement set forth in claim 1 for use in a diesel engine having a fuel line for supplying fuel to said at least one fuel injection pump, wherein said control rod is constructed and arranged to be axially movable to one end position and to inhibit an injection of fuel from said at least one fuel injection pump when said control rod is in said one end position, further comprising shutdown means for moving said control rod to said one end position in response to a drop of the fuel pressure in said fuel line, said shutdown means comprising a shutdown piston, a shutdown lever operatively connecting said shutdown piston and said control rod and adapted to move said control rod toward said one end position in response to a movement of said shutdown piston in one direction, a shutdown spring biasing said shutdown piston in said one direction, and means for applying fluid pressure from said fuel line so as to oppose the force of said shutdown spring.

7. In apparatus for controlling the injection of fuel from at least one fuel injection pump in a diesel engine, comprising a control rod which is axially adjustable and adapted to control said at least one fuel injection pump in dependence on the axial position of said control rod, a stepping motor having a rotary output shaft, and a mechanism comprising a resiliently yieldable coupling and connected to said shaft and to said control rod and adapted to impart an axial movement to said control rod in response to a rotary movement of said shaft, the improvement residing in that said mechanism comprises a camwheel, which is nonrotatably connected to said shaft and has a cam, and a spring biasing said control rod in one axial direction to bear on said cam through the intermediary of said resiliently yieldable coupling so that said control rod is adapted to move against the force of said spring in response to a rotation of said camwheel in one sense, wherein said control rod carries an abutment, said resiliently yieldable coupling comprises first and second coupling levers, which are pivotally movable relative to each other about a common axis, said first coupling lever is pivotally movable toward said second coupling lever into engagement with said cam, said second coupling lever is pivotally movable toward said first coupling lever into engagement with said abutment and said resiliently yieldable coupling comprises a spring urging said first and second coupling levers toward each other and into engagement with said cam and abutment, respectively.

8. The improvement set forth in claim 7, as applied to apparatus in which said control rod is adapted to control the quantity of fuel injected by said at least one fuel injection pumps per shot.

9. The improvement set forth in claim 7, as applied to apparatus in which said control rod is adapted to control the beginning of the injection of fuel from each of said at least one fuel injection pumps for each shot.

10. The improvement set forth in claim 7, wherein said resiliently yieldable coupling comprises a stop carried by one of said coupling levers and engageable by the other of said coupling levers.

11. The improvement set forth in claim 10, wherein said one coupling lever is said first coupling lever.

12. The improvement set forth in claim 7, wherein said coupling spring is a tension spring.

13. The improvement set forth in claim 7, for use in a diesel engine having a fuel line for supplying fuel to said at least one fuel injection pump, as applied to apparatus in which said control rod is axially movable to one end position and adapted to inhibit an injection of fuel from said at least one fuel injection pump when said control rod is in said one end position, wherein shutdown means for moving said control rod to said one end position in response to a drop of the fuel pressure in said fuel line comprise a shutdown piston, which is operatively connected to said control rod and adapted to move said control rod toward said one end position by a movement of said shutdown piston in one direction, a shutdown spring biasing said shutdown piston in said one direction, and means for applying fluid pressure from said fuel line so as to oppose the force of said shutdown spring.

14. The improvement set forth in claim 13, wherein said shutdown piston is operatively connected to said control rod by said second coupling lever.

15. In apparatus for controlling the injection of fuel from at least one fuel injection pump in a diesel engine, comprising a control rod which is axially adjustable and adapted to control said at least one fuel injection pump in dependence on the axial position of said control rod, a stepping motor having a rotary output shaft, and a mechanism comprising a resiliently yieldable coupling and connected to said shaft and to said control rod and adapted to impart an axial movement to said control rod in response to a rotary movement of said shaft, the improvement residing in that said mechanism comprises a camwheel, which is rotatable about the axis of said shaft and has a cam and is operatively connected in series with said resiliently yieldable coupling between said shaft and said control rod, and a spring biasing said control rod to bear indirectly on said cam so that said control rod is adapted to move against the force of said spring in response to a rotation of said camwheel in one sense, wherein said resiliently yieldable coupling comprises first and second interengageable, rigid coupling means, which are angularly movable relative to each other and arranged to interengage during a rotation of said camwheel in a sense which is opposite to said one sense, and are capable of a limited movement relative to each other in a sense corresponding to a rotation of said camwheel in said one sense, and spring means urging said first and second coupling means toward each other.

16. The improvement set forth in claim 15, for use in a diesel engine having a fuel line for supplying fuel to said at least one fuel injection pump, as applied to apparatus in which said control rod is axially movable to one end position and adapted to inhibit an injection of fuel from said at least one fuel injection pump when said control rod is in said one end position, wherein shutdown means for moving said control rod to said one end position in response to a drop of the fuel pressure in said fuel line comprise a shutdown piston, a shutdown lever operatively connecting said shutdown piston and said control rod and adapted to move said control rod toward said one end position in response to a movement of said shutdown piston in one direction, a shutdown spring biasing said shutdown piston in said one direction, and means for applying fluid pressure from said fuel line so as to oppose the force of said shutdown spring.

* * * * *